United States Patent [19]

Ryan

[11] Patent Number: 4,643,306

[45] Date of Patent: Feb. 17, 1987

[54] POSTAL TRAY

[75] Inventor: Patrick Ryan, Reseda, Calif.

[73] Assignee: Alpha Mail Systems, Newport Beach, Calif.

[21] Appl. No.: 796,248

[22] Filed: Nov. 8, 1985

[51] Int. Cl.[4] ..... B65D 1/34; B65D 21/02

[52] U.S. Cl. ..... 206/425; 206/44 B; 206/503; 206/509; 206/558; 211/50; 312/107.5; 312/183; 312/193

[58] Field of Search ..... 206/425, 44 B, 503, 206/508, 509, 511, 558, 557, 816, 449, 555, 556; 211/495, 50, 88; 312/183, 193, 107.5; 220/19, 329

[56] References Cited

U.S. PATENT DOCUMENTS

| | | | |
|---|---|---|---|
| 1,030,317 | 6/1912 | Middough | 206/558 |
| 2,235,709 | 3/1941 | Hearn et al. | 206/558 |
| 2,491,652 | 12/1949 | Feerick | 211/73 |
| 2,575,919 | 11/1951 | Kautzmann et al. | 206/558 |
| 2,894,640 | 7/1959 | Bigelow | 206/558 |
| 2,914,189 | 11/1959 | Bishop et al. | 206/449 |
| 3,259,269 | 7/1966 | Asenbauer | 206/509 |
| 3,885,668 | 5/1975 | McClain | 206/505 |
| 4,162,024 | 7/1979 | Shanley | 206/816 |
| 4,560,072 | 12/1985 | Burrett | 211/88 |

FOREIGN PATENT DOCUMENTS

| | | | |
|---|---|---|---|
| 1200498 | 7/1970 | United Kingdom | 220/19 |
| 1076369 | 2/1984 | U.S.S.R. | 220/19 |

*Primary Examiner*—William Price
*Assistant Examiner*—Brenda J. Ehrhardt
*Attorney, Agent, or Firm*—Matthew P. Lynch

[57] ABSTRACT

A postal tray to facilitate the sorting and distribution of mail in the form of a box-like configuration having an open top and an open front. The tray includes a plurality of removable partitions which when used forms a series of pockets within which is to be located mailing envelopes. An elongated rod is included within the tray with the rod being movable from an access position to a position preventing accidental dislodgement of mailing envelopes from the pockets. The tray includes brackets formed on the upper surface thereof to facilitate stacking with another tray. Also, each tray is provided with a pair of tie down brackets which are to be connected with an elongated member such as a bar to tie together stacked postal trays.

5 Claims, 5 Drawing Figures

POSTAL TRAY

BACKGROUND OF THE INVENTION

This invention relates to trays which are designed to facilitate the sorting and distribution of mail.

At the present time, within Post Offices, postal employees sort mail for delivery by manually inserting the separate articles of mail (mostly envelopes) into pigeonholes formed within a cabinet. This cabinet is fixedly mounted within the Post Office. Each pigeonhole contains appropriate identifying indicia to denote the particular party to whom the mail located within that particular pigeonhole is to be delivered.

Once all the mail has been sorted, the mail is then removed from the pigeonholes and placed in unpartioned delivery trays. The trays containing the mail is then transported to a vehicle for delivery to the houses and commercial places of business on the postal route.

This conventional method of distribution of mail is a multi-step operation which physically requires: (1) sorting of the mail into the individual pigeonholes, (2) removing the sorted mail from the pigeonholes and arranging it in order in the unpartioned delivery trays, (3) resorting each piece of mail to ensure that all the mail addressed to a particular addressee is correctly delivered, and (4) placing all mail for each particular delivery in the addressee's mail receptacle. If just one of these steps could be eliminated, literally millions of dollars in labor expense could be saved each and every day because of the massive volume of mail that is delivered each day. This savings would be applicable only to the United States with similar savings obtainable throughout the rest of the world.

SUMMARY OF THE INVENTION

The primary objective of the structure of the present invention is to construct a portable postal tray which can be used for sorting of the mail and then the postal tray placed directly within the vehicle for delivery of the mail thereby eliminating the steps of: (1) removing the mail from the sorted location within the Post Office, (2) arranging the mail within the unpartioned delivery trays and (3) resorting each piece of mail prior to delivery to the addressee.

The postal tray of the present invention is formed of a box-like configuration having an open top and an open front. Associated with the open top and open front is a movable bar which can be moved to a lower position to prevent accidental disengagement of any envelopes or letters that have been sorted and stacked within the tray. The sorted envelopes are to be positioned between removable partitions that are mounted within the tray. Associated with each tray are brackets to facilitate stacking of trays, one on top of the other. Also, when stacked there is attached to each tray a tie down bracket to facilitate connection with a tie down rod to secure together the stacked trays.

DETAILED DESCRIPTION OF THE SHOWN EMBODIMENT

Figure 1:
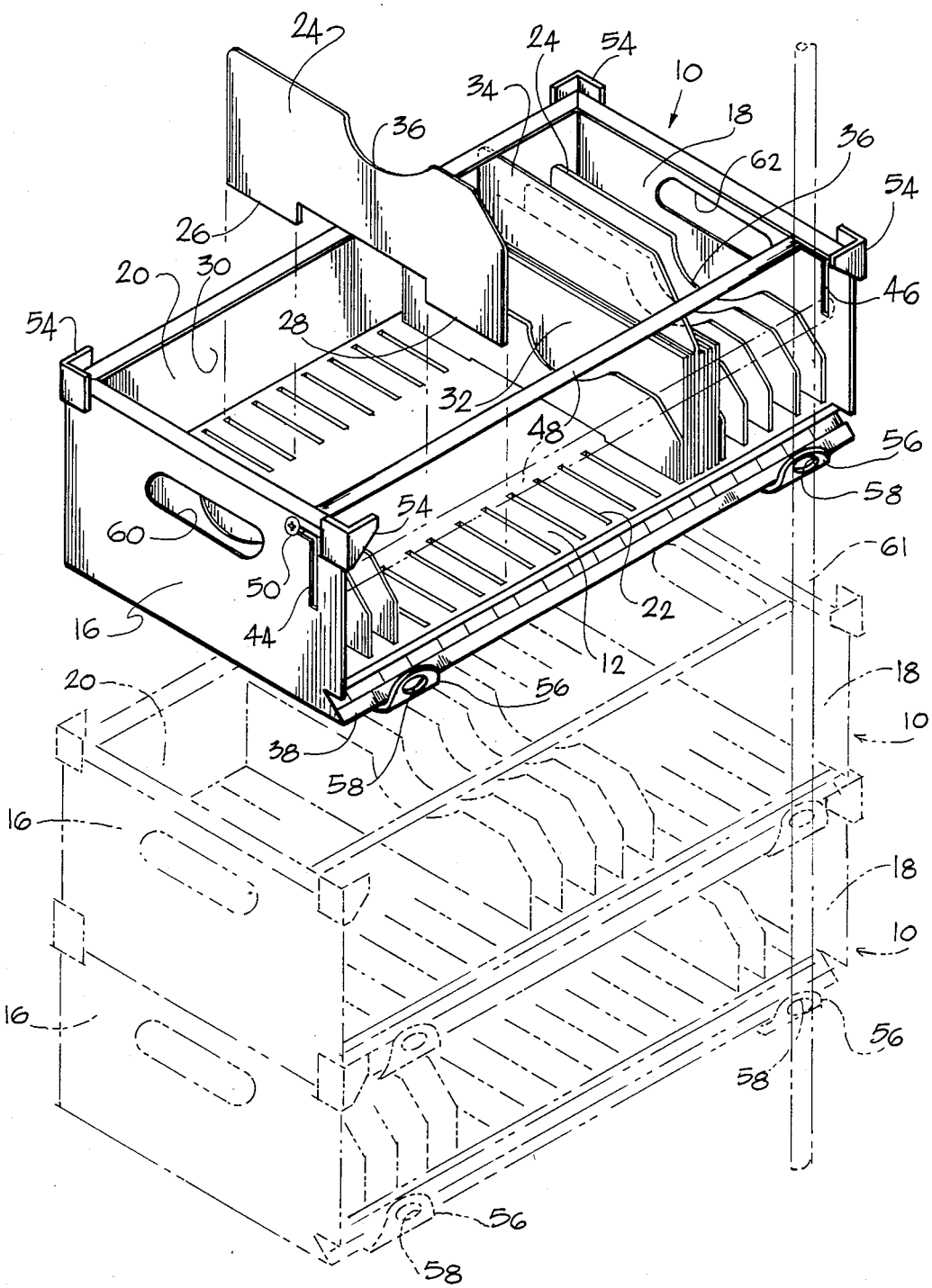
FIG. 1 is an isometric view of the postal tray of the present invention showing other similar types of postal trays in phanton depicting how the trays are to be stacked.
Figure 2:
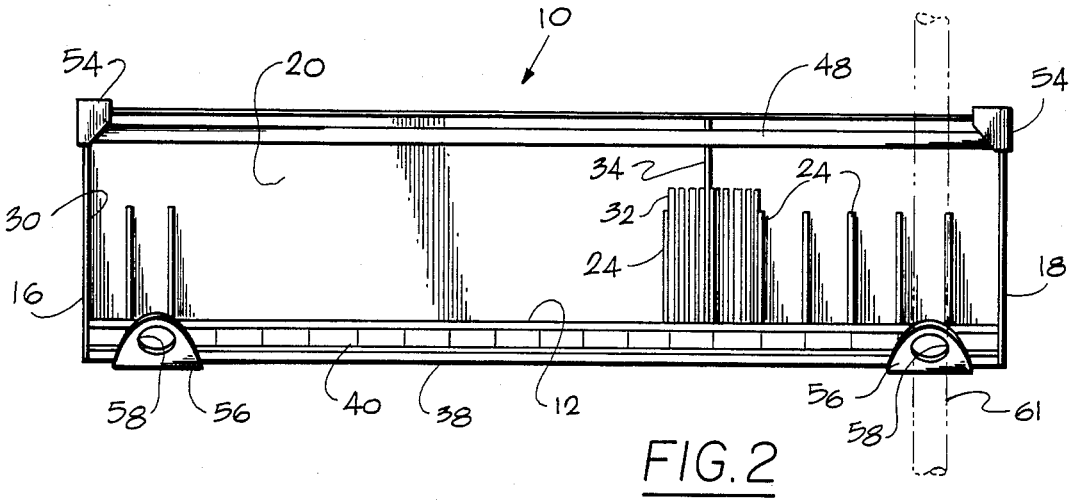
FIG. 2 is a front elevational view of the postal tray of the present invention.
Figure 3:
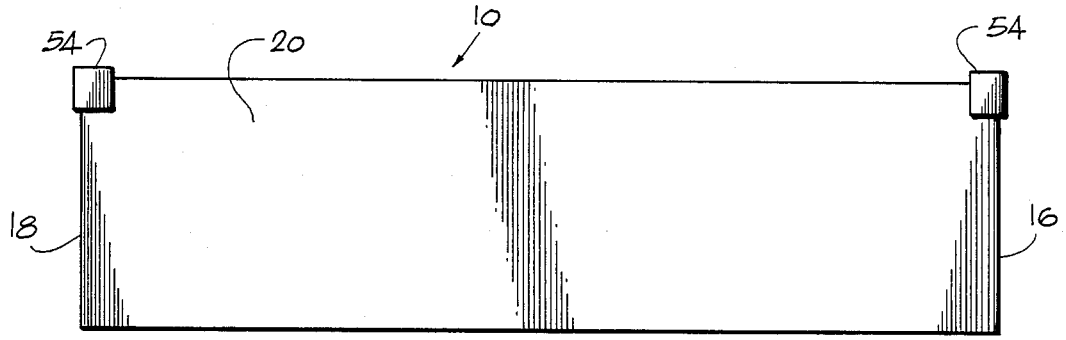
FIG. 3 is a back elevational view of the postal tray of the present invention.
Figure 4:
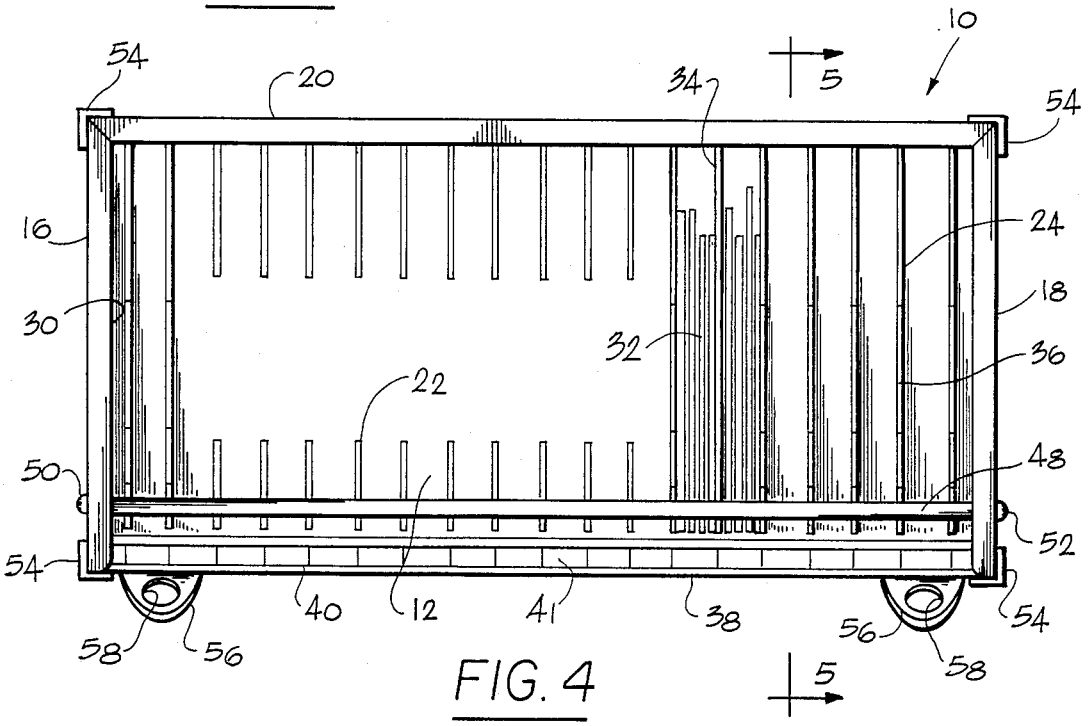
FIG. 4 is a top plan view of the postal tray of the present invention.

Referring particularly to the drawings, there is shown the postal tray 10 of this invention which is of a box-like configuration formed of a substantially planar bottom wall 12 which has a basic rectangular configuration. The bottom wall 12 has a peripheral edge 14. Fixedly mounted one side of the peripheral edge 14 is a left side wall 16. A similar side wall 18 is fixedly mounted to the right edge of the peripheral edge 14. The side walls 16 and 18 are similar in configuration with side wall 18 being substantially a mirror image of side wall 16. Also attached to the peripheral edge 14 and extending between and attached to the back ends of the side walls 16 and 18 is a back wall 20. It is understood that the back wall 20 as well as side walls 16 and 18 will be formed of planar sheet material such as sheet metal.

Formed within the bottom wall 12 are a plurality of spaced-apart slots or openings 22. It is noticed that there is a forward series of openings 22 and a rearward series of openings 22. A sheet metal partition 24 has extensions 26 and 28 which are to be locatable within the internal chamber 30 defined by the bottom wall 22 and located between side walls 16 and 18 and forward of the back wall 20. The extensions 26 and 28 are to connect with a single pair of aligned foward and rearward openings 22 and, when so located, each partition 24 will be supported in an upright manner as is clearly shown within the drawings. It is to be understood that there may be utilized any number of partitions 24 with there being produced between directly adjacent partitions 24 a pocket or space within which is to be located mailing envelopes 32. The mailing envelopes 32 are to be located within the pocket or space in a side-by-side manner. The user has the option of selecting the location of each partition 24 so that either large in size of pockets can be created or small sized pockets can be created.

Also, a divider plate 34 can be used at appropriate desired locations in between the partitions 24 to divide sections of the mail located between directly adjacent partitions 24. Further, the partitions 24 may include a hollowed out area 36 to facilitate observing of an address on an envelope 32 without removing of the envelopes 32 from the pocket.

Normally it would be desirable to assign some type of number, name or address, or other type of identifying indicia to each respective pocket. For this reason there is fixedly mounted on a depending lower front edge 38 a channel 40. Small pieces of paper 41 are to be slid and held within the channel 40 and located in direct alignment with a particular pocket. Imprinted on the piece of paper 41 is to be the appropriate desired identifying indicia. The depending flange 38 is formed integral with the bottom wall 12.

Figure 5:
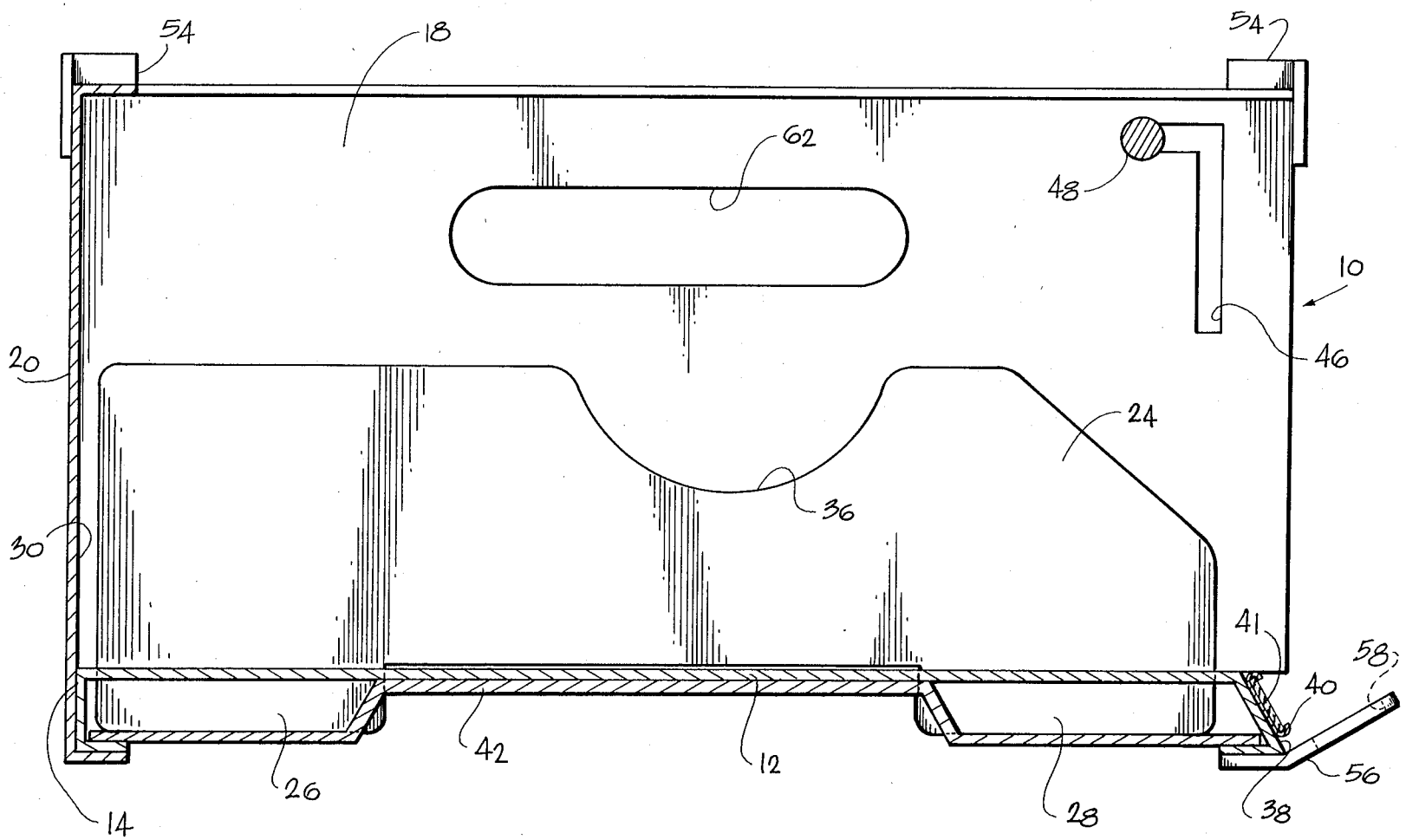
FIG. 5 is a cross-sectional view through the postal tray of the present invention taken along line 5—5 of FIG. 4.

Mounted on the underneath side of the bottom wall 12 is a lower cover member 42. This cover member 42 is fixed to the bottom wall 12. The extensions 26 and 28 of each partition 24 will actually come to rest against portions of the cover member 42 as is shown in FIG. 5 of the drawings.

Formed within the side wall 16 is an L-shaped slot 44. A similar L-shaped slot 46 is formed within the side wall 18. The slots 44 and 46 are in alignment with respect to each other. Located between the slots 44 and 46, and connecting therewith, is a rod 48. The rod 48 is retained in position with respect to the slot 44 by enlarged headed fastener 50. In a similar manner the opposite end of the rod 48 is held in position with the slot 46 by means of enlarged headed fastener 52. The fasteners 50 and 52 are not tightened onto their respective side walls 16 and 18 so as to permit movement of the rod 48 from the upper position (solid line position shown in FIG. 1) to a lower position (shown in dotted lines in FIG. 1).

With the rod 48 in the upper position, envelopes 32 can be easily slid to within a pocket through the front wall of the tray 10. When the desired amount of mail has been placed within the tray 10, the postal employee only need to move the bar 48 to the lower position which will prevent any of the envelopes 32 from accidentally falling from the tray 10 during transporting of the tray. In order to remove the envelopes 32 from the tray 10, the postal employee may grab the envelopes 32 and remove such from the top rod 48 in the lower position or, when the rod 48 is in the upper position, the envelopes 32 can be removed through the front of tray 10.

Fixedly mounted on the tray 10 at the top edge thereof and at each corner of tray 10 is a stacking bracket 54. It is to be understood that there are four in number of the brackets 54 for each tray 10. The position of each of the brackets 54 is such that the bottom edge of a tray 10 can be positioned directly onto the top edge of another tray 10 and are held in that position by means of the brackets 54. Stacking of the trays 10 is clearly shown within FIG. 1 and there will be no trouble to normally stack as many as a half a dozen of the trays 10 on top of each other.

When the tray 10 is so stacked, it may be desirable to interlock together the trays 10 to prevent any of the trays 10 from spilling their contents during transporting of the mail within a vehicle. This interlocking together is achieved by using a pair of tie down brackets 56 fixedly mounted onto the depending flange 38. Each of the brackets 56 has an outer upwardly extending section which includes a hole 58. A bar 61 or other similar type of elongated exterior structure is to be insertable through aligned holes 58 of the tie down brackets 56 of the stacked trays 10.

In order to facilitate portability of each of the trays 10, there is included within the side wall 16 a handle opening 60 with a similar handle opening 62 being formed within the side wall 18.

What is claimed is:

1. A postal tray facilitating the sorting and distribution of mail comprising:

a housing, said housing having a planar bottom wall which has a peripheral edge, a pair of planar side walls attached to said peripheral edge and extending from said bottom wall, a planar back wall attached to said peripheral edge and extending from said bottom wall, said back wall located between said side walls, said housing having an open top and open front, an internal chamber defined by said bottom wall and enclosed by said side walls and said back wall;

an opening assembly formed within said bottom wall, said opening assembly connecting with said internal chamber;

a plurality of planar partition members removably mounted within said opening assembly, said partition members extending within said internal chamber, pockets being formed between directly adjacent partition members, said pockets being adapted to receive postal envelopes; and a rod connected to said side walls and extending therebetween, said rod being located directly adjacent said top and directly adjacent said front, said rod being movable with respect to said side walls between an upper position and a lower position, said upper position locating said rod across said top, said lower position locating said rod across said front.

2. The postal tray as defined in claim 1 wherein:

each said side wall including an L-shaped slot, an end of said rod connecting with each said slot, the length of said slots defining the length of movement of said rod from said upper position to said lower position.

3. The postal tray as defined in claim 2 including:

a stacking bracket assembly mounted on said side walls and said back wall, said stacking bracket assembly adapted to facilitate stacking with another said postal tray.

4. The postal tray as defined in claim 3 including:

a tie down bracket mounted on said bottom wall, said tie down bracket including a hole, said hole being adapted to connect with a separate tie down device to fix in position said postal tray during transporting of said postal tray from one location to another.

5. The postal tray as defined in claim 4 including:

each said side wall including a handle opening, said handle openings facilitating manual grapsing for lifting and transporting of said postal tray.

* * * * *